US012629556B2

(12) United States Patent
Beck

(10) Patent No.: US 12,629,556 B2
(45) Date of Patent: May 19, 2026

(54) WEIGHTED ZIPPER PULL

(71) Applicant: Paul Beck, St. Louis, MO (US)

(72) Inventor: Paul Beck, St. Louis, MO (US)

( * ) Notice: Subject to any disclaimer, the term of this patent is extended or adjusted under 35 U.S.C. 154(b) by 76 days.

(21) Appl. No.: 18/658,675

(22) Filed: May 8, 2024

(65) Prior Publication Data

US 2025/0170444 A1 May 29, 2025

Related U.S. Application Data

(60) Provisional application No. 63/603,925, filed on Nov. 29, 2023.

(51) Int. Cl.

| | |
|---|---|
| ***A63B 5/11*** | (2006.01) |
| ***A44B 19/24*** | (2006.01) |
| ***A63B 71/00*** | (2006.01) |

(52) U.S. Cl.

CPC ..... *A63B 5/11* (2013.01); *A44B 19/24* (2013.01); *A63B 71/0054* (2013.01); *A63B 2208/12* (2013.01)

(58) Field of Classification Search

CPC ..... A63B 5/11; A63B 71/0054; A63B 71/022; A63B 2208/12; A63B 2208/30; A44B 19/24; A44B 19/262; Y10T 24/2586

USPC ..... 24/429

See application file for complete search history.

(56) References Cited

U.S. PATENT DOCUMENTS 3,719,973 A * 3/1973 Bell ..... A44B 19/262 24/429
5,083,349 A * 1/1992 Axtell ..... A44B 19/262 24/429
5,249,832 A * 10/1993 Leonardz ..... A47G 25/902 223/111

(Continued)

FOREIGN PATENT DOCUMENTS

CN 214050309 U 10/2020
CN 217523988 U 6/2022

(Continued)

OTHER PUBLICATIONS

YKK Digital, CONCEAL® with Semi-auto Lock Slider (Slider Code: DS) https://www.ykkfastening.com/products/search/detail.html?pdid1=CONCEAL(R) as early as Oct. 7, 2023.

*Primary Examiner* — Megan Anderson
(74) *Attorney, Agent, or Firm* — Stinson LLP

(57) ABSTRACT

A weighted zipper pull for automatically closing an entrance such as a trampoline entrance, includes a weighted member, a resealable opening, and a zipper attachment portion. The weighted member is configured to at least one of receive and release material through the resealable opening to adjust a weight of the weighted member. The zipper attachment portion of the weighted zipper pull is used to attach the weighted zipper pull to a zipper that is operably connected to an entrance such that a slider body of the zipper is moveable in relation to the zipper between a lower closed position wherein the entrance is closed and an upper open position wherein the entrance is opened. When the weighted (Continued)

zipper pull is attached to the zipper, the weighted zipper pull pulls the slider body from the upper open position to the lower closed position by gravity to automatically close the entrance.

13 Claims, 16 Drawing Sheets

(56) References Cited

U.S. PATENT DOCUMENTS

| | | | | |
|---|---|---|---|---|
| 5,975,386 | A * | 11/1999 | Fernicola | A47G 25/902 223/111 |
| 7,971,279 | B2 * | 7/2011 | Abanto | A44B 19/24 2/218 |
| 8,764,081 | B1 * | 7/2014 | Krieger | A44B 19/262 24/429 |
| 9,855,452 | B2 * | 1/2018 | Chen | A63B 71/023 |
| 10,780,334 | B2 | 9/2020 | Nilsson et al. | |
| 2007/0157440 | A1 * | 7/2007 | Malkin | A44B 19/262 24/429 |
| 2019/0060692 | A1 * | 2/2019 | Chang | A63B 71/022 |

FOREIGN PATENT DOCUMENTS

| | | | |
|---|---|---|---|
| DE | 102021105113 | B4 | 3/2021 |
| WO | WO2015101982 | A1 | 12/2014 |

* cited by examiner

WEIGHTED ZIPPER PULL

CROSS-REFERENCE TO RELATED APPLICATIONS

This application claims the benefit of U.S. Provisional Patent Application Ser. No. 63/603,925, filed on Nov. 29, 2023, the entire contents of which are hereby incorporated by reference.

FIELD

The present disclosure generally relates to trampoline netting systems, and more particularly to a weighted zipper pull for automatically closing trampoline netting system entrances.

BACKGROUND

Nearly all household trampolines are sold with netting systems to protect users from falling off the trampolines during use. Similarly, bouncy houses generally include netting systems to protect users from falling off of the bouncy houses during use. Furthermore, the netting systems generally include large entrances for entering the trampolines and bouncy houses that are equipped with conventional zippers for opening and closing the entrances.

SUMMARY

Aspects of the present disclosure permit a weighted zipper pull for automatically closing a trampoline entrance.

In one aspect, a weighted zipper pull for automatically closing an entrance, wherein the entrance comprises a zipper that is operably connected to the entrance such that a slider body of the zipper is moveable in relation to the zipper between a lower closed position wherein the entrance is closed and an upper open position wherein the entrance is opened, comprises a weighted member. The weighted member comprises a zipper attachment portion for attaching the weighted member to the slider body of the zipper. When the weighted member is attached to the slider body, the weighted member is configured to pull the slider body from the upper open position to the lower closed position by gravity to automatically close the entrance.

In another aspect, a zipper configured for automatically closing a trampoline entrance of a trampoline enclosure, the trampoline enclosure configured to surround a rebounding surface of a trampoline, the trampoline entrance providing access by a user to the rebounding surface, comprises a zipper track. The zipper track is operably connected to the trampoline entrance. A weighted zipper pull is operably connected to the zipper track such that the weighted zipper pull is moveable along the zipper track between a lower closed position wherein the trampoline entrance is closed and an upper open position wherein the trampoline entrance is opened. The weighted zipper pull is configured to automatically move from the upper open position to the lower closed position by gravity to automatically close the trampoline entrance.

In another aspect, a trampoline comprises a frame configured to support a rebounding surface. An enclosure surrounding the rebounding surface is configured to inhibit a user from falling off the rebounding surface during use. The enclosure has a trampoline entrance therein providing access by the user to the rebounding surface. A zipper is operably connected to the trampoline entrance. The zipper has a slider body moveable in relation to the zipper between a lower closed position wherein the trampoline entrance is closed and an upper open position wherein the trampoline entrance is opened. A weighted zipper pull is configured to pull the slider body from the upper open position to the lower closed position by gravity to automatically close the trampoline entrance.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Netting systems for trampolines are used to prevent users from falling off the trampolines during play. A netting system for a trampoline is generally configured to surround the trampoline's rebounding or jumping surface and typically includes a large entrance for users to enter and leave the trampoline. The entrance is often equipped with a conventional zipper for opening and closing the entrance. Undoubtedly, it is very common for users (especially children) to leave the large entrances of the trampoline netting systems open during use of the trampolines. Furthermore, even when only a portion of the entrances are left open, conventional zippers for opening and closing the entrances have a natural tendency to separate due to tension of the netting system caused by user movement. The inventor has recognized that despite the effort to provide a safer jumping environment to users with netting systems, the large entrances of such netting systems for trampolines still pose the same hazard to users of falling off the trampoline when the large entrances are open during use.

The present disclosure generally pertains to a weighted zipper pull that can be attached to a zipper of a trampoline entrance on a trampoline, and used to automatically close the trampoline entrance. In an embodiment, the weighted zipper pull can be removably attached to the zipper of the trampoline entrance. The weighted zipper pull can be made of low-cost materials, and provides an additional safety feature for trampolines that can be mindlessly used by trampoline users to mitigate the risk of falling off of a trampoline as will be described in further detail below.

Figure 1:
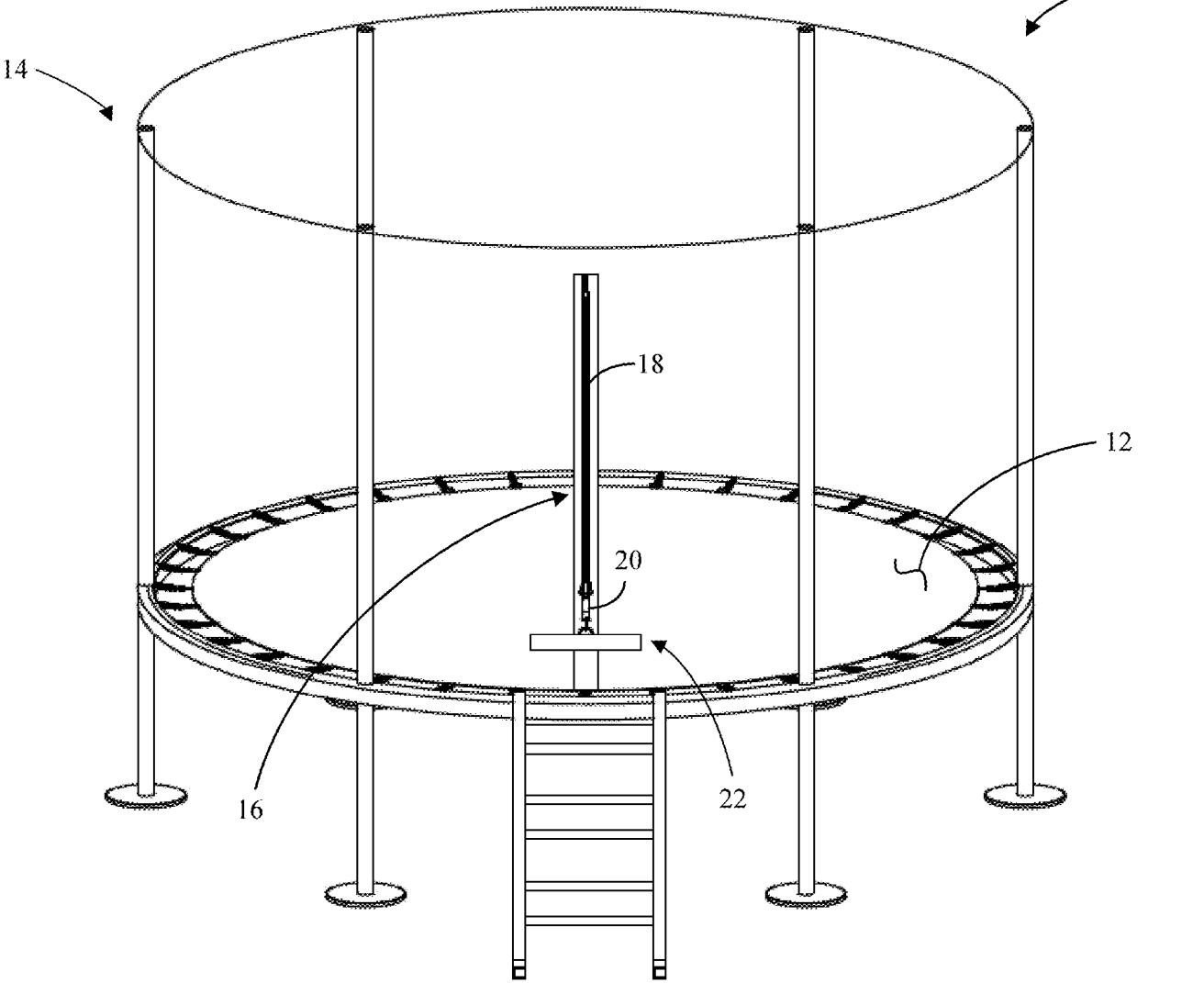
FIG. 1 is an illustration of a trampoline, according to an embodiment.

Referring now to FIG. 1, a trampoline in accordance with the present disclosure is generally indicated at reference number 10. The trampoline 10 comprises a frame configured to support a rebounding surface 12. Furthermore, the trampoline 10 comprises an enclosure 14 (e.g., a netting system) that surrounds the rebounding surface 12 and is configured to inhibit a user from falling off the rebounding surface during use. The enclosure 14 further comprises a trampoline entrance 16 therein for providing access by the user to the rebounding surface 12. A zipper 18 is operably connected to the trampoline entrance 16 for opening and closing the trampoline entrance. The zipper 18 further comprises a zipper track and a slider body 20 that is moveable along the zipper track between a lower closed position wherein the trampoline entrance 16 is closed and an upper open position wherein the trampoline entrance is opened. A weighted zipper pull 22 is operably connected to the zipper 18 and configured to automatically move from the upper open position to the lower closed position by gravity to automatically close the trampoline entrance 16.

Figure 2A:
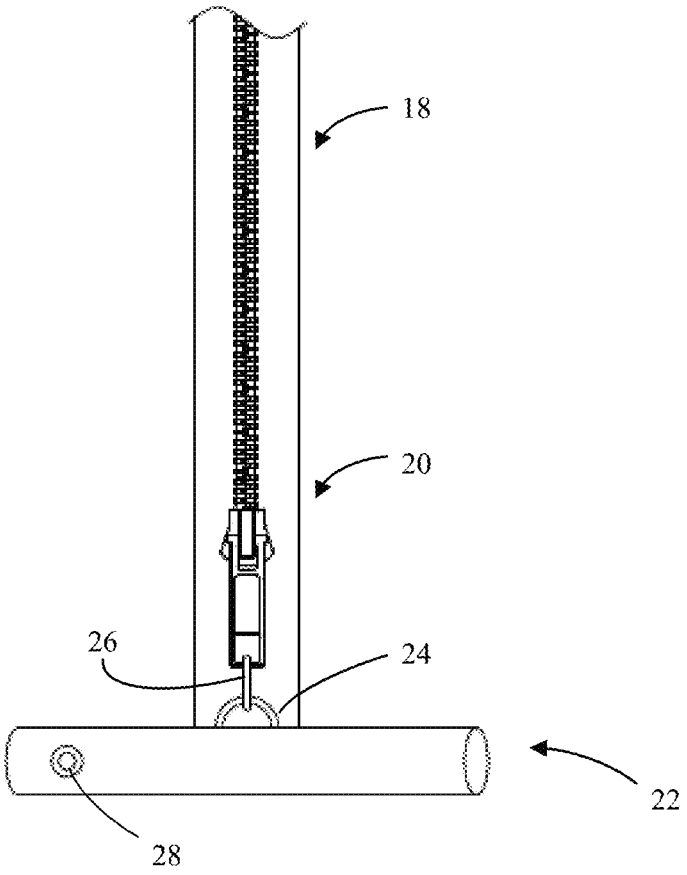
FIG. 2A is an illustration of a weighted zipper pull attached to a zipper of a trampoline net entrance with a fastening device, according to an embodiment.
Figure 2B:
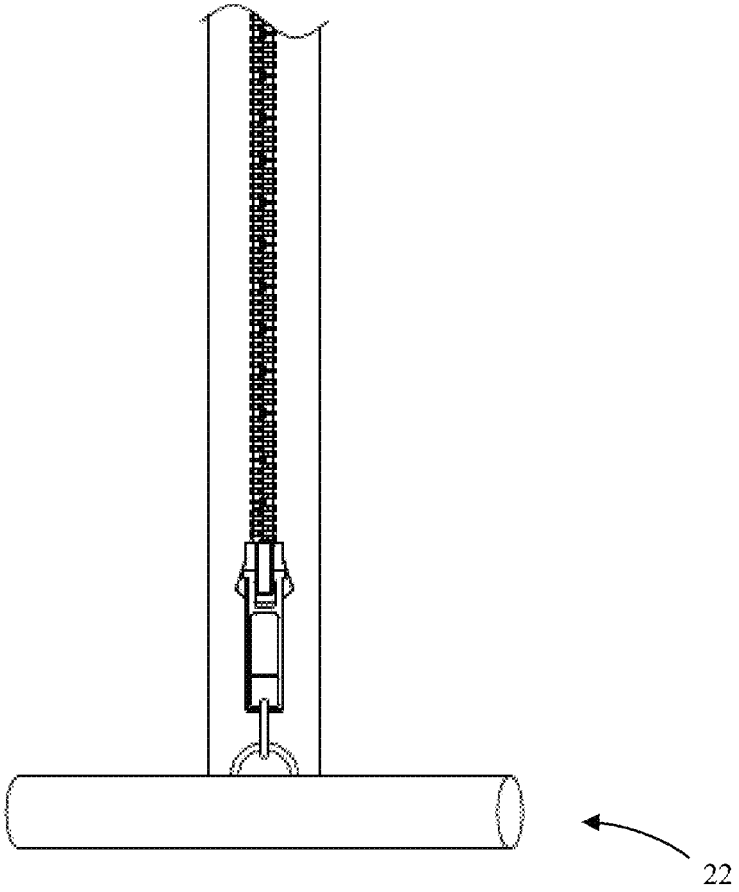
FIG. 2B is an illustration of a weighted zipper pull attached to a zipper of a trampoline net entrance with a fastening device, according to an embodiment.
Figure 2C:
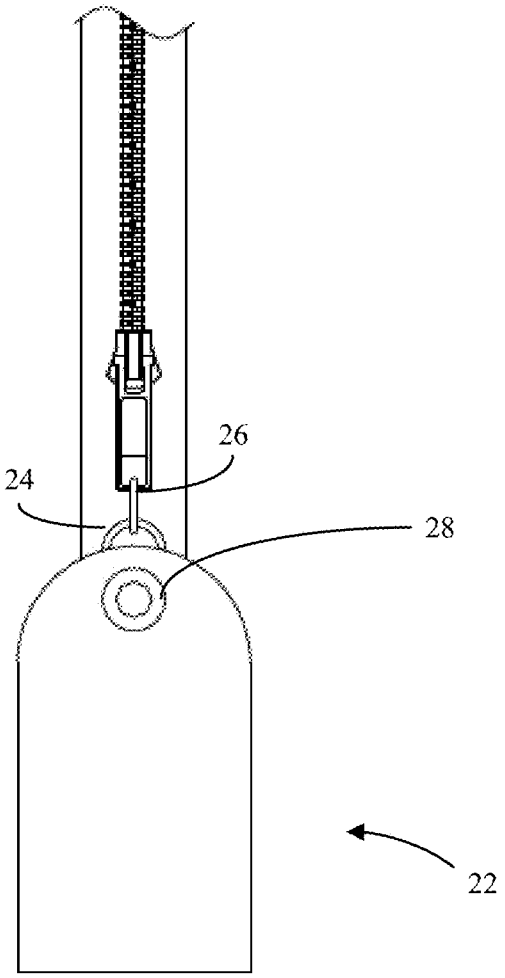
FIG. 2C is an illustration of a weighted zipper pull attached to a zipper of a trampoline net entrance with a fastening device, according to an embodiment.
Figure 2D:
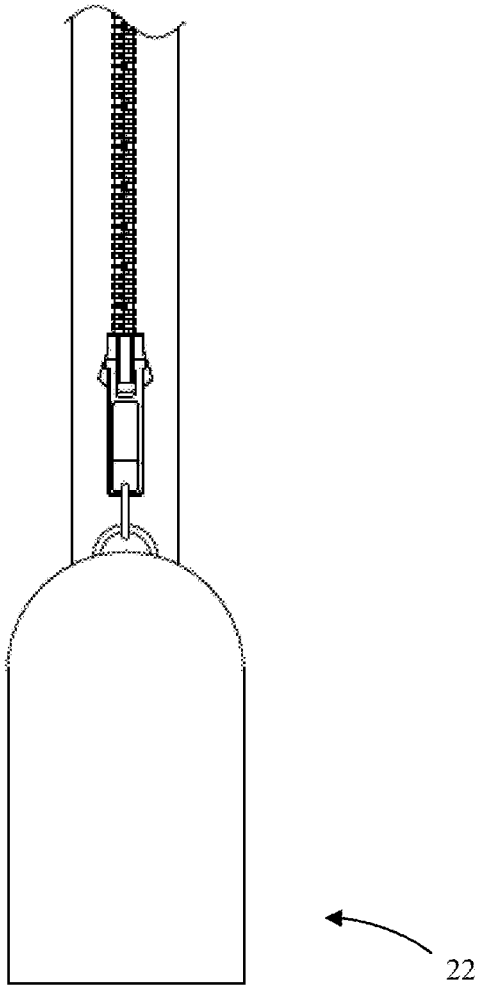
FIG. 2D is an illustration of a weighted zipper pull attached to a zipper of a trampoline net entrance with a fastening device, according to an embodiment.
Figure 2E:
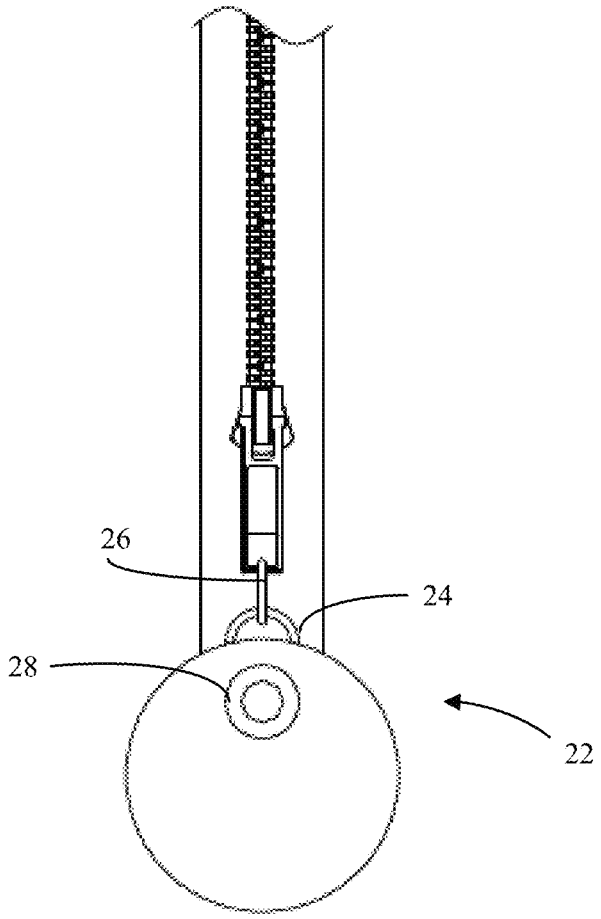
FIG. 2E is an illustration of a weighted zipper pull attached to a zipper of a trampoline net entrance with a fastening device, according to an embodiment.
Figure 2F:
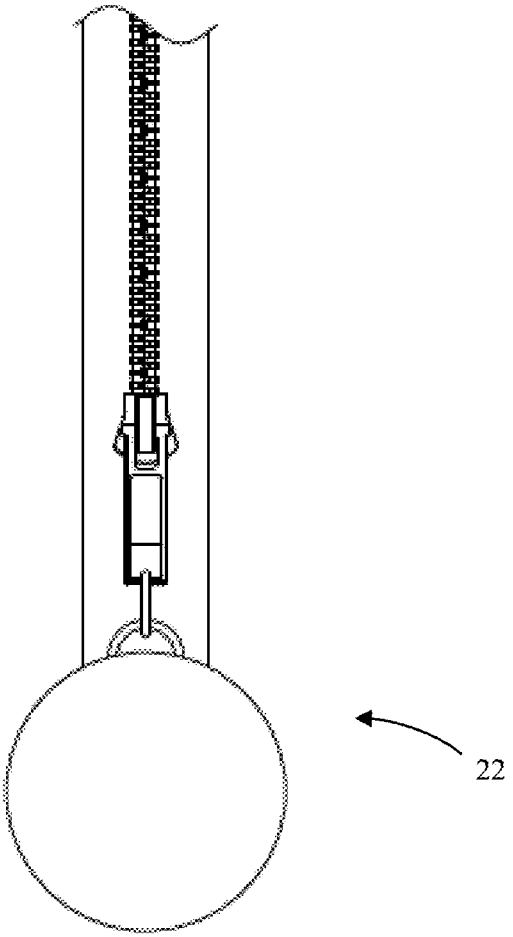
FIG. 2F is an illustration of a weighted zipper pull attached to a zipper of a trampoline net entrance with a fastening device, according to an embodiment.
Figure 3A:
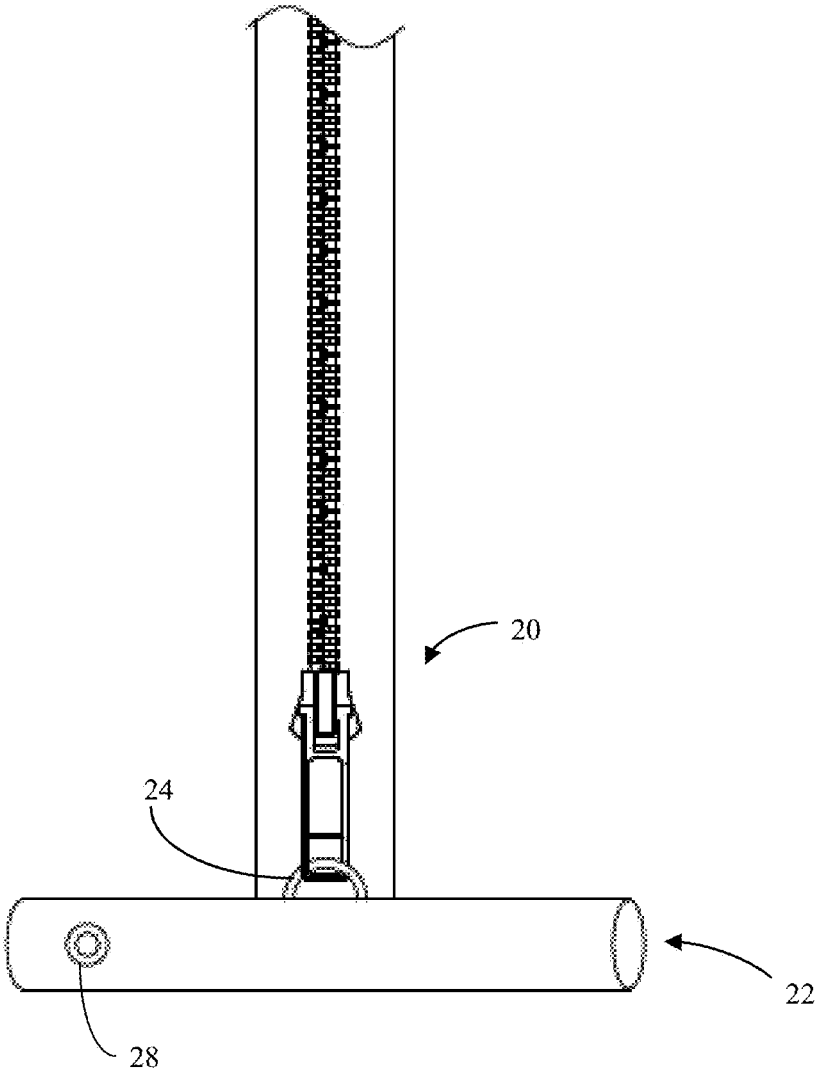
FIG. 3A is an illustration of a weighted zipper pull attached to a zipper of a trampoline net entrance, according to an embodiment.
Figure 3B:
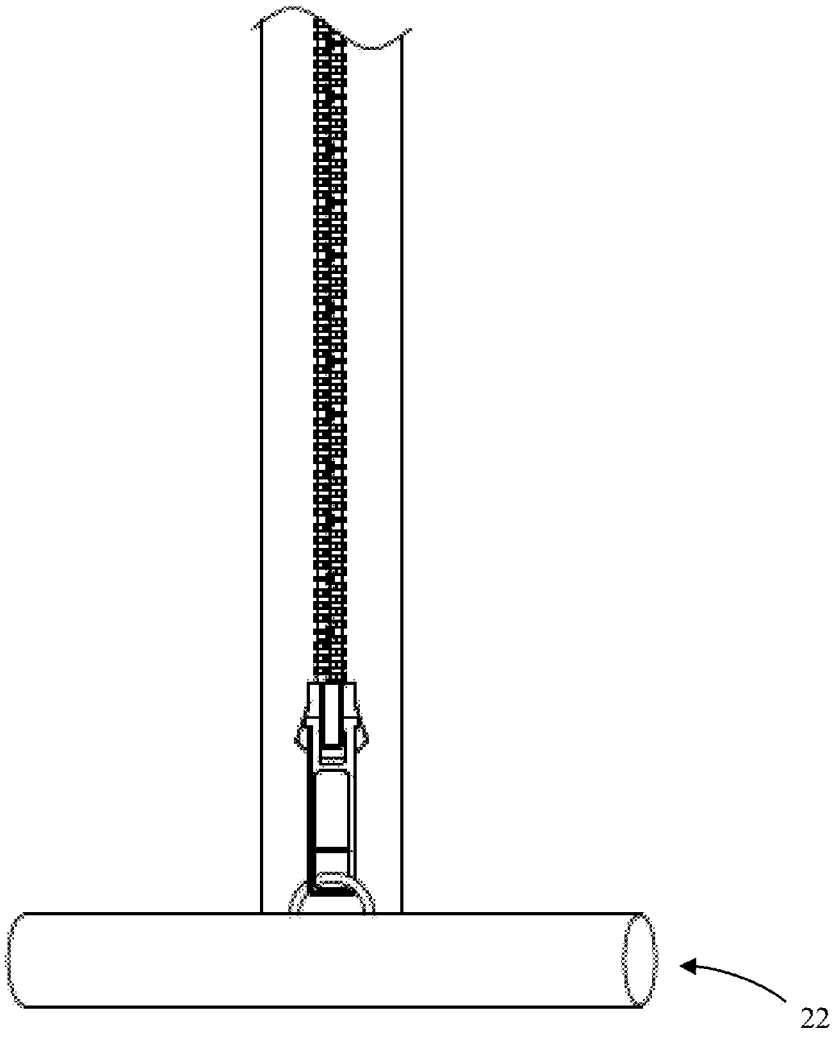
FIG. 3B is an illustration of a weighted zipper pull attached to a zipper of a trampoline net entrance, according to an embodiment.
Figure 3C:
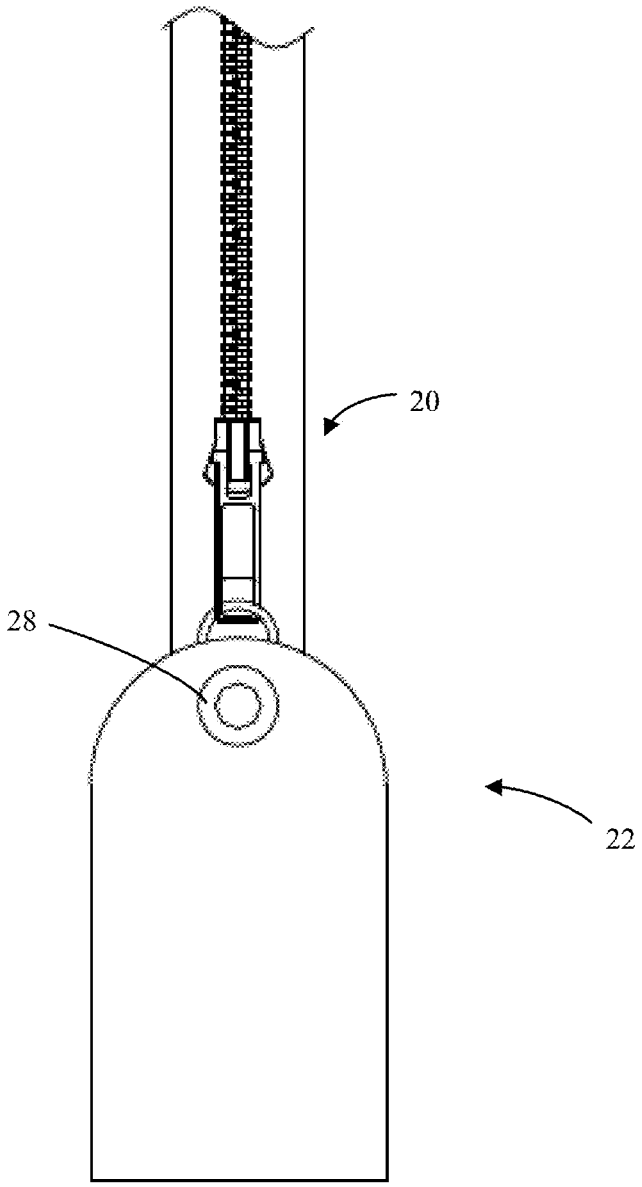
FIG. 3C is an illustration of a weighted zipper pull attached to a zipper of a trampoline net entrance, according to an embodiment.
Figure 3D:
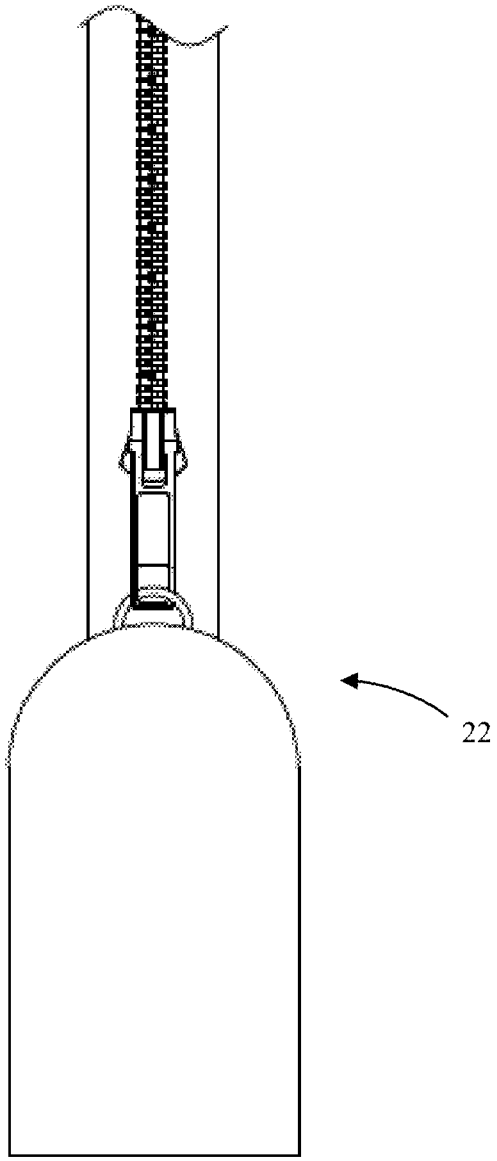
FIG. 3D is an illustration of a weighted zipper pull attached to a zipper of a trampoline net entrance, according to an embodiment.
Figure 3E:
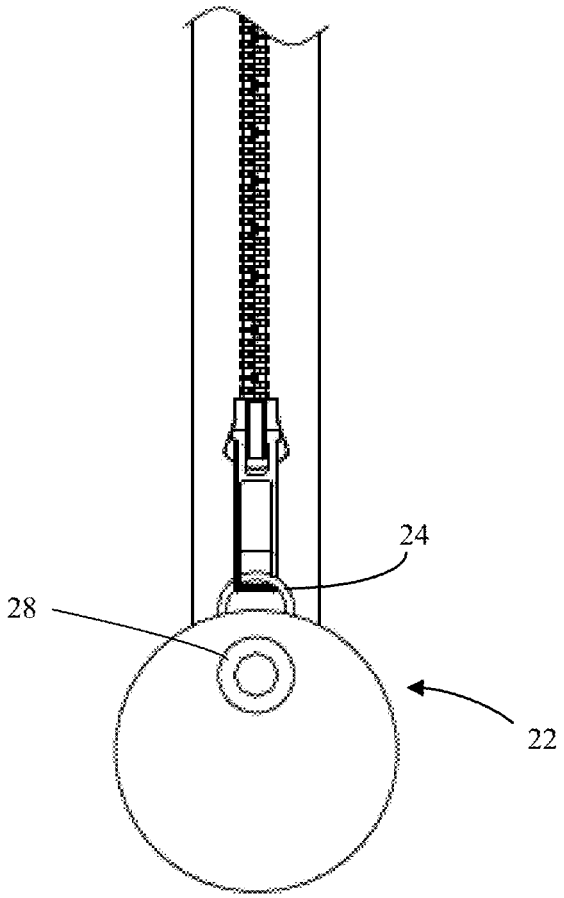
FIG. 3E is an illustration of a weighted zipper pull attached to a zipper of a trampoline net entrance, according to an embodiment.
Figure 3F:
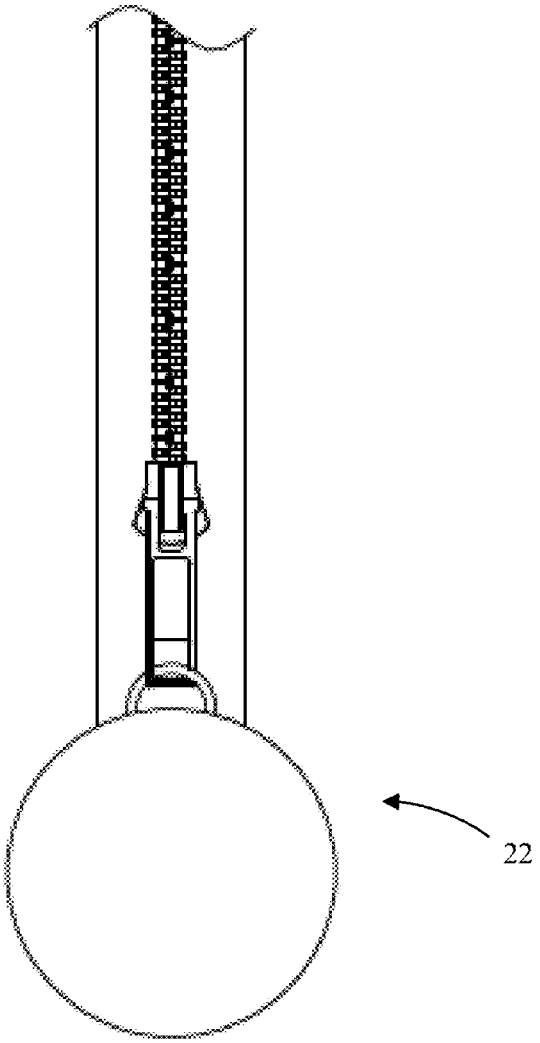
FIG. 3F is an illustration of a weighted zipper pull attached to a zipper of a trampoline net entrance, according to an embodiment.
Figure 3G:
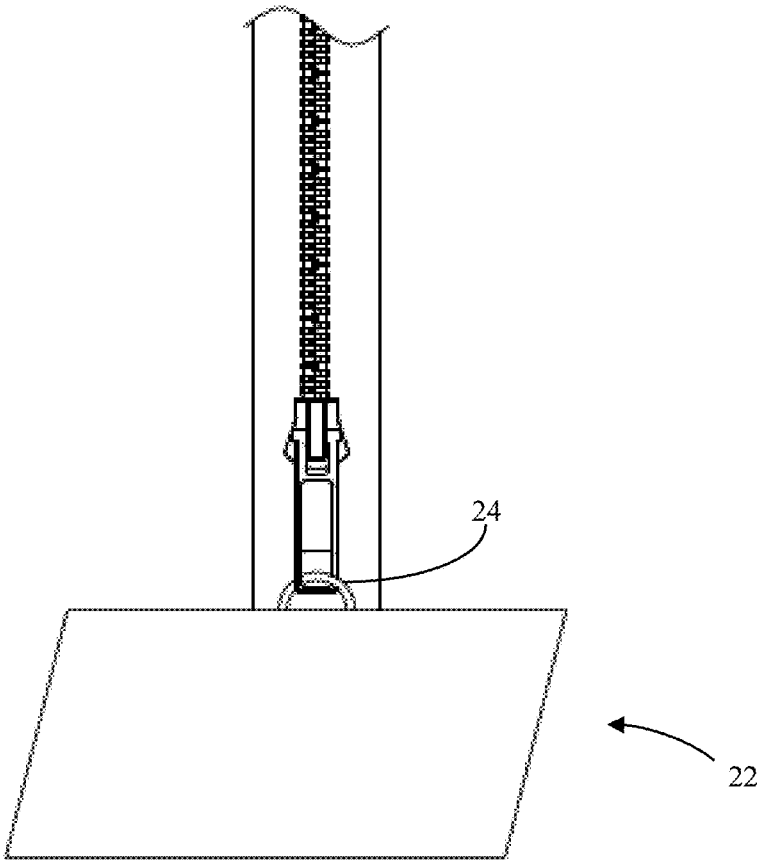
FIG. 3G is an illustration of a weighted zipper pull attached to a zipper of a trampoline net entrance, according to an embodiment.
Figure 4:
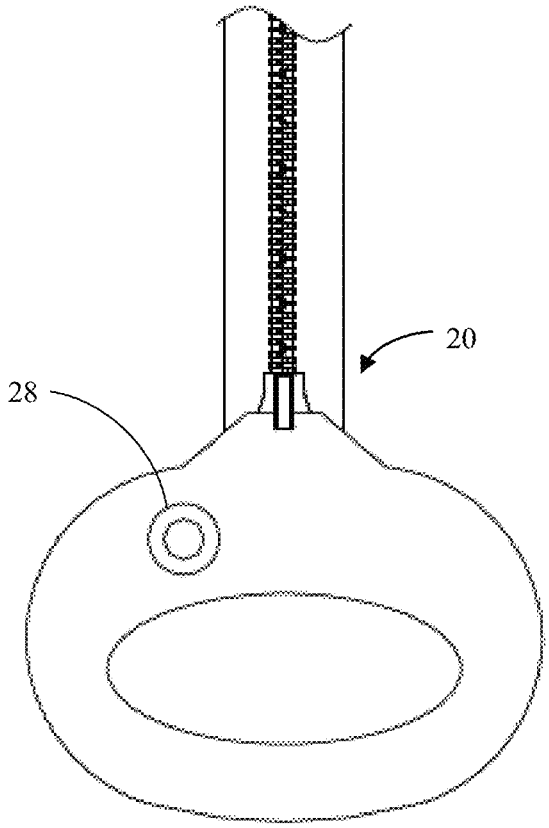
FIG. 4 is an illustration of a weighted zipper pull attached to a zipper track of a trampoline net entrance, according to an embodiment.

Referring now to FIG. 2A, an exemplary embodiment of a weighted zipper pull in accordance with the present disclosure is generally indicated at reference number 22. The weighted zipper pull 22 broadly comprises a weighted member comprising a zipper attachment portion 24 for attaching the weighted zipper pull to the slider body 20 of the zipper 18. In the illustrated embodiment, the zipper attachment portion 24 comprises a loop that is configured to receive a fastening device 26 for removably fastening the weighted member to the slider body 20 of the zipper 18, however it is apparent that other configurations of the zipper attachment portion may be used to attach the weighted zipper pull to the zipper without departing from the scope of the present disclosure. Furthermore, different types of fastening devices 26 such as a heavy duty clip and a heavy duty Zip Tie may be used to attach the zipper attachment portion 24 to the zipper 18. In an alternative embodiment, the zipper attachment portion 24 is configured to attach the weighted zipper pull 22 to the zipper 18 without the use of a fastening device 26. For example, in FIGS. 2A-2G the weighted zipper pull 22 is attached to a zipper pull tab of the slider body 20 with fastening device 26, whereas in FIGS. 3A-3G the weighted zipper pull is attached directly to the zipper pull tab of slider body 20. In FIG. 4, the weighted zipper pull 22 is configured as the zipper pull tab of the slider body 20.

In an exemplary embodiment, the weighted member of the weighted zipper pull 22 further comprises a resealable opening 28 for at least one of receiving and releasing material for adjusting a weight of the weighted member. In one embodiment, the weighted zipper pull 22 includes a removable lid that is configured to be secured to the weighted zipper pull to close the opening 28. For example, materials such as sand, rice, or water may be added to the weighted member through the opening 28 and contained within the weighted member via the lid to increase the weight of the weighted zipper pull 22 to a sufficient weight wherein when the weighted zipper pull is attached to the slider body 20 and the slider body is in an upper open position, the weight of the weighted zipper pull automatically pulls the slider body to the lower closed position by gravity to automatically close the trampoline entrance 16. Contrastingly, the lid may be removed from the opening 28 to allow material to be released from the weighted member, such that the weight of the weighed zipper pull 22 decreases.

Generally, the weighted zipper pull 22 is shaped and arranged to (i) attach to the zipper 18, (ii) have a weight that is sufficient for automatically closing the trampoline entrance 16, (iii) be safely used by users, and to (iv) be easily used by users to open and close the trampoline entrance. Regarding point (i), the weighted zipper pull 22 is shaped and arranged to include zipper attachment portion 24 according to an embodiment for removably attaching the weighted zipper pull to the zipper 18 as described above. In one embodiment, the zipper attachment portion 24 is formed with the weighted member as a single piece. In another embodiment, the zipper attachment portion 24 is formed separately from the weighted member and securely attached to the weighted member to form the weighted zipper pull.

With respect to point (ii) from above, the weighted zipper pull 22 is shaped and arranged to have a weight that is sufficient for automatically closing the trampoline entrance 16 when attached to the slider body 20 of the zipper 18. For example, the weighted zipper pull 22 is shaped and arranged to hold a sufficient amount of material, such that the weight of the weighted zipper pull with the material automatically closes the trampoline entrance 16. The weighted zipper pull 22 may also be formed of a material that effectively contributes to the weight of the weighted zipper pull. In an exemplary embodiment, the weighted zipper pull 22 is sized and formed from a material such that the weight of the weighted zipper pull alone is sufficient to close the trampoline entrance 16 without the need to add extra material. The weight necessary for automatically closing the trampoline entrance 16 is largely dependent on the type of zipper 18 being used. Said differently, some zippers may require heavier weighted zipper pulls 22, whereas with other zippers lighter weighted zipper pulls are sufficient. In one example, the weighted zipper pull 22 is formed from a heavy duty soft rubber material that is configured to hold an inclusive range of 0.5 gallons to 1 gallon of water which weighs an inclusive range of 4-8 pounds. In another example, the weighted zipper pull 22 is formed from a hollow PVC pipe that does not require any extra material to close the trampoline entrance, as the weight of the PVC is sufficient.

With respect to point (iii) from above, the weighted zipper pull 22 is shaped and arranged to be safely used by users. For example, in one embodiment the weighted zipper pull 22 is shaped and arranged to seat on an exterior portion of the trampoline netting system 14 as opposed to the weighted zipper pull entering through the trampoline entrance 16 to an interior portion of the trampoline netting system where the rebounding surface 12 is. This reduces the risk of users bumping into the weighed zipper pull 22 during use of the trampoline and furthermore prevents the weighted zipper pull from rebounding on the rebounding surface 12. In one example, the weighted zipper pull 22 is shaped and arranged to include a length that is sufficient to prevent the weighted zipper pull from entering through the trampoline entrance 16 to the interior portion of the trampoline netting system 14. As indicated above, the weighted zipper pull 22 may be formed from a plurality of different material types. However, the weighted zipper pull 22 may be advantageously formed from soft materials such as heavy duty fabric or heavy duty soft rubber for extra precaution regarding the safety of the trampoline users.

Figure 2G:
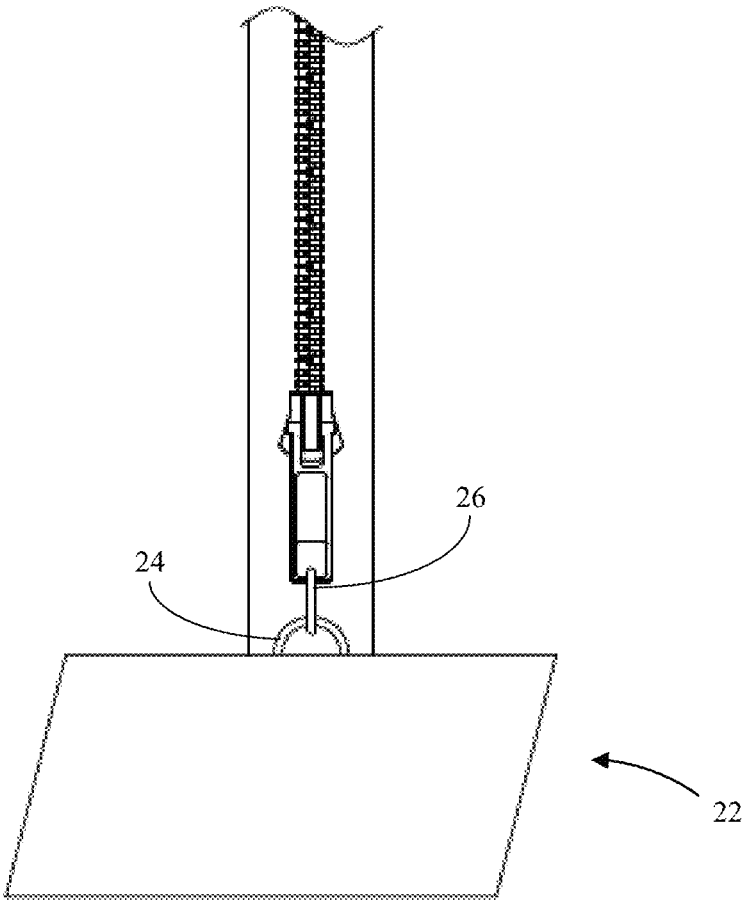
FIG. 2G is an illustration of a weighted zipper pull attached to a zipper of a trampoline net entrance with a fastening device, according to an embodiment.

In respect to point (iv) the weighted zipper pull 22 is shaped and arranged to be easily used by trampoline users such that the trampoline users may pull the weighted zipper pull upward in the upper open position to open the trampoline entrance 16 to access the trampoline and then release the weighted zipper pull to automatically close the trampoline entrance. Suitably, the weighted zipper pull 22 can be formed as a plurality of different shapes. For example, in FIGS. 1, 2A, 2B, 3A, and 3B the weighted member of the weighted zipper pull 22 comprises a cylindrical tube. In FIGS. 2C, 2D, 3C, and 3D the weighted member of the weighted zipper pull comprises a pouch. In FIGS. 2E, 2F, 3E, and 3F the weighted member of the weighted zipper pull 22 comprises a ball. In FIGS. 2G and 3G the weighted member of the weighted zipper pull 22 comprises a bean bag. In FIG. 4, the weighted zipper pull 22 comprises the zipper pull tab that includes a grip portion. In any case, the weighted zipper pull 22 is configured to be easily handled by users.

The weighted zipper pull 22 is described above as being used to automatically close the trampoline entrance 16 of the trampoline 10, however it is envisioned that the weighted zipper pull 22 may be used with any device having a zipper entrance. For example, it is contemplated that the weighted zipper pull 22 may be attached to devices with zipper entrances such as bouncy houses, tents, bug nets, etc., to automatically close the entrances thereof.

The weighted zipper pull 22 of the present disclosure provides several safety advantages for trampoline users at a relatively low manufacturing cost. The weighted zipper pull 22 automatically closes a large, opened trampoline entrance 16 once users enter the trampoline 10 to mitigate the risk of users jumping, falling, or being pushed through the trampoline entrance. Consequently, the weighted zipper pull 22 will reduce injuries suffered by trampoline users (typically children), and will alleviate frustration and stress of parents who constantly remind their children to close the zipper after entering the trampoline.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above products without departing from the scope of the invention, it is intended that all matter contained in the above description and shown in the accompanying drawings shall be interpreted as illustrative and not in a limiting sense.

The Abstract and Summary are provided to help the reader quickly ascertain the nature of the technical disclosure. They are submitted with the understanding that they will not be used to interpret or limit the scope or meaning of the claims. The Summary is provided to introduce a selection of concepts in simplified form that are further described in the Detailed Description. The Summary is not intended to identify key features or essential features of the claimed subject matter, nor is it intended to be used as an aid in determining the claimed subject matter.

The invention claimed is:

1. A zipper configured for automatically closing a trampoline entrance of a trampoline enclosure, the trampoline enclosure configured to surround a rebounding surface of a trampoline, the trampoline entrance providing access by a user to the rebounding surface, the zipper comprising:

a zipper track operably connected to the trampoline entrance;

a weighted zipper pull operably connected to the zipper track such that the weighted zipper pull is moveable along the zipper track between a lower closed position wherein the trampoline entrance is closed and an upper open position wherein the trampoline entrance is opened, the weighted zipper pull being configured to automatically move from the upper open position to the lower closed position by gravity to automatically close the trampoline entrance.

2. The zipper of claim 1, wherein the weighted zipper pull comprises a hollow weighted member.

3. The zipper of claim 2, wherein the weighted zipper pull further comprises an opening for at least one of receiving and releasing material for adjusting a weight of the weighted zipper pull.

4. The zipper of claim 3, further comprising a removable lid configured to close the opening.

5. The zipper of claim 1, wherein the weighted zipper pull further comprises a gripping portion configured to be gripped by a user to move the weighted zipper pull along the zipper track.

6. A trampoline comprising:

a frame configured to support a rebounding surface;

an enclosure surrounding the rebounding surface and configured to inhibit a user from falling off the rebounding surface during use, the enclosure having a trampoline entrance therein providing access by the user to the rebounding surface;

a zipper operably connected to the trampoline entrance, the zipper having a slider body moveable in relation to the zipper between a lower closed position wherein the trampoline entrance is closed and an upper open position wherein the trampoline entrance is opened; and a weighted zipper pull configured to pull the slider body from the upper open position to the lower closed position by gravity to automatically close the trampoline entrance.

7. The trampoline of claim 6, wherein the weighted zipper pull is removably attached to the slider body.

8. The trampoline of claim 6, wherein the weighted zipper pull further comprises a loop configured to receive a fastening device for removably fastening the weighted zipper pull to the slider body of the zipper.

9. The trampoline of claim 6, wherein the weighted zipper pull comprises a fabric pouch.

10. The trampoline of claim 6, wherein the weighted zipper pull has a cylindrical shape.

11. The trampoline of claim 6, wherein the weighted zipper pull comprises a resealable opening for at least one of receiving and releasing material for adjusting a weight of the weighted zipper pull.

12. The trampoline of claim 6, wherein the weighted zipper pull comprises a length that prevents the weighted zipper pull from entering through the trampoline entrance to the rebounding surface.

13. The trampoline of claim 6, wherein the weighted zipper pull is seated on an exterior portion of the enclosure.

* * * * *